US007484624B2

(12) United States Patent
Saika

(10) Patent No.: US 7,484,624 B2
(45) Date of Patent: Feb. 3, 2009

(54) GRANULAR BODY-PROCESSING APPARATUS

(75) Inventor: Keiji Saika, Wakayama (JP)

(73) Assignee: Toyo Rice Cleaning Machines Co., Ltd. (JP)

( * ) Notice: Subject to any disclaimer, the term of this patent is extended or adjusted under 35 U.S.C. 154(b) by 487 days.

(21) Appl. No.: 10/547,894

(22) PCT Filed: Mar. 1, 2004

(86) PCT No.: PCT/JP2004/002513

§ 371 (c)(1),
(2), (4) Date: Sep. 2, 2005

(87) PCT Pub. No.: WO2004/078353

PCT Pub. Date: Sep. 16, 2004

(65) Prior Publication Data

US 2007/0163924 A1 Jul. 19, 2007

(30) Foreign Application Priority Data

Mar. 4, 2003 (JP) ..... 2003-056802

(51) Int. Cl.
*B07B 1/10* (2006.01)

(52) U.S. Cl. ..... 209/307; 209/312; 209/321; 209/380; 209/22; 460/101; 34/371

(58) Field of Classification Search ..... 209/643, 209/307, 312, 321, 21, 22, 28, 30, 36, 380; 460/97–102; 34/361, 364, 365, 367, 371; 99/603, 608, 616, 617

See application file for complete search history.

(56) References Cited

U.S. PATENT DOCUMENTS

| | | | | |
|---|---|---|---|---|
| 243,944 | A * | 7/1881 | Moore | 209/22 |
| 931,060 | A * | 8/1909 | Hage | 209/543 |
| 1,530,193 | A * | 3/1925 | Montgomery | 209/321 |
| 3,739,907 | A * | 6/1973 | Kilgour et al. | 209/26 |
| 4,261,817 | A * | 4/1981 | Edwards et al. | 209/321 |
| 4,678,560 | A * | 7/1987 | Stole et al. | 209/23 |

(Continued)

FOREIGN PATENT DOCUMENTS

| | | |
|---|---|---|
| JP | 49-5303 | 2/1974 |

(Continued)

OTHER PUBLICATIONS

Patent Abstracts of Japan, English Language Abstract for Publication No. 64-085063.

(Continued)

*Primary Examiner*—Patrick H Mackey
*Assistant Examiner*—Mark Hageman
(74) *Attorney, Agent, or Firm*—Sterne, Kessler, Goldstein & Fox P.L.L.C.

(57) ABSTRACT

A grain processor comprises a conveyor, air-suction means, and air-blowing means. The conveyor has a surface defining a conveying course on which grains are disposed, and the surface has holes smaller than the grains. The air above the surface is sucked downward through the holes by the air-suction means. The air-blowing means blows air upward through the holes at a predetermined position in the conveying course so as to apply blowing-up force onto the conveyed grains on the surface reaching the predetermined position.

4 Claims, 3 Drawing Sheets

U.S. PATENT DOCUMENTS

| | | | | |
|---|---|---|---|---|
| 5,098,586 | A * | 3/1992 | Rudolph | 210/785 |
| 6,220,446 | B1 * | 4/2001 | Witt et al. | 209/303 |
| 2002/0029700 | A1 * | 3/2002 | Yamamoto et al. | 99/519 |

FOREIGN PATENT DOCUMENTS

| | | |
|---|---|---|
| JP | 56-30573 | 3/1981 |
| JP | 64-85063 | 3/1989 |
| JP | 05-192594 | 8/1993 |
| JP | 07-106321 | 11/1995 |

OTHER PUBLICATIONS

Patent Abstracts of Japan, English Language Abstract for Publication No. 05-192594.

Patent Abstracts of Japan, English Language Abstract for Publication No. 07-106321.

International Search Report for International Application No. PCT/JP2004/002513, Japanese Patent Office, mailed on May 24, 2004.

* cited by examiner

GRANULAR BODY-PROCESSING APPARATUS

BACKGROUND OF THE INVENTION

1. Field of the Invention

The present invention relates to a grain processor which can substantially completely separate accretions or contaminants from grains without damaging surfaces of the grains. The present invention also relates to a grain processor which can dry up grains uniformly for a short time without damaging surfaces of the grains.

2. Background Art

Conventionally, there is a well-known device for separating accretions or contaminants from grains while conveying the grain, and for drying wet grain while conveying the grains. A rotary net conveyor is an example of such a device.

However, the conventional rotary net conveyor simply blows air through a porous net either upward or downward (or sucks air downward), thereby being hard to ensure grains with no addition to be processed without being damaged.

Conventionally, as disclosed in the Japanese Patent Laid Open Gazette Sho. 64-85063, there are well-known method and device such that grains polluted by soil or the like are mixed with an abrasive abstergent and thrown into a dryer, and the mixture, while being conveyed and dried up by hot air, is agitated so as to grind the grains by the abrasive abstergent.

However, this conventional method and device cannot remove soil or the like adhering to grains without using the abrasive abstergent. On the other hand, the wind for drying up grains must be weak so as to prevent the grains from dispersing, whereby grains can't be dried up for a short time.

Further, as disclosed in the Japanese Patent Hei. 7-106321, (Publication 05-192594). there is a well-known drying device provided with a rotatable net, over which grains from washing and dehydrating means are spread, and with a suction blower at the lower side of the net so as to suck air downward.

This conventional device, which can suck air powerfully, is expected to dry up grains for a short time. However, once grains adhering to one another are sucked and caught on the net, they cannot be exchanged in place, thereby causing uneven dryness. This uneven dryness may happen to not only each grain, but also to upper and lower layers of grain lump processed on the net. If the grains sucked and caught on the net are agitated for preventing the uneven dryness, the lumping grains are rubbed hard with one another to be roughed at their surfaces. Also, when the porous lump-like grains are pushed out from the net to a discharge opening to be discharged, the grains are rubbed with one another or with the net so as to be roughed at their surfaces. Further, the drying air of this conventional device merely passes among the separate grains and cannot penetrate a bond of grains, whereby dust or the like accreting to the grain or intermingled with the grain can't be separated from the grain.

SUMMARY OF THE INVENTION

An object of the present invention is to provide a grain processor which can substantially completely separate accretions and contaminants from grains without damaging surfaces of the grains and with no addition.

To achieve the object, a grain processor comprises a conveyor, air-suction means, and air-blowing means. The conveyor has a substantially horizontal surface defining a conveying course on which grains are disposed, and the surface is provided with holes smaller than the grains. The air above the surface is sucked downward through the holes by the air-suction means. The air-blowing means blows air upward through the holes at a predetermined position in the conveying course so as to apply blowing-up force onto the conveyed grains on the surface reaching the predetermined position.

By the above grain processor, the conveyed grains on the surface of the conveyor are subjected to the downward suction air through the holes so as to be separated from accretions and contaminants, and if the grains reach the predetermined position, the grains receive the upward air through the holes by the air-blowing means so as to be blown up, thereby being turned in place relative to one another and exposing the hidden portions of the grains to the air so as to separate remaining accretions and contaminations, whereby accretions and contaminants can be separated from the grains without damaging surfaces of the grains and with no addition, and can dry up the grains uniformly for a short time without damaging surfaces of the grains.

Preferably, the holes are larger than accretions accreting to the grains or contaminants intermingled with the grains.

Accordingly, the separated accretions and contaminants can be discharged through the holes.

Preferably, the width of blowing air by the air-blowing means is substantially as large as the width of the conveying course.

Accordingly, the blowing-up air power is applied onto the grains in the whole cross direction of the conveying course, whereby the accretions and contaminants can be further surely separated from the grains without damaging surfaces of the grains.

Preferably, the conveyor is constituted by a turntable which is circular when viewed in plan and rotated by a motor.

Accordingly, the grain processor can be entirely miniaturized while keeping the sufficient length of the conveying course required for processing the grains.

Preferably, a screw serving as discharging means for discharging the grains from the conveying course is disposed in the conveying course, and the air-blowing means is disposed below the discharging means.

Accordingly, the grains are floated up from the conveying course by the air power from the air-blowing means, and then all the grains are discharged by the rotation of the screw without being damaged at their surfaces.

These, further and other objects, features and effects of the present invention will appear more fully from the following description with reference to the accompanying drawings.

BEST MODE FOR CARRYING OUT THE INVENTION

The invention will be described in detail according to attached drawings.

Firstly, a grain processor according to a first embodiment of the present invention will be described.

Figure 1:
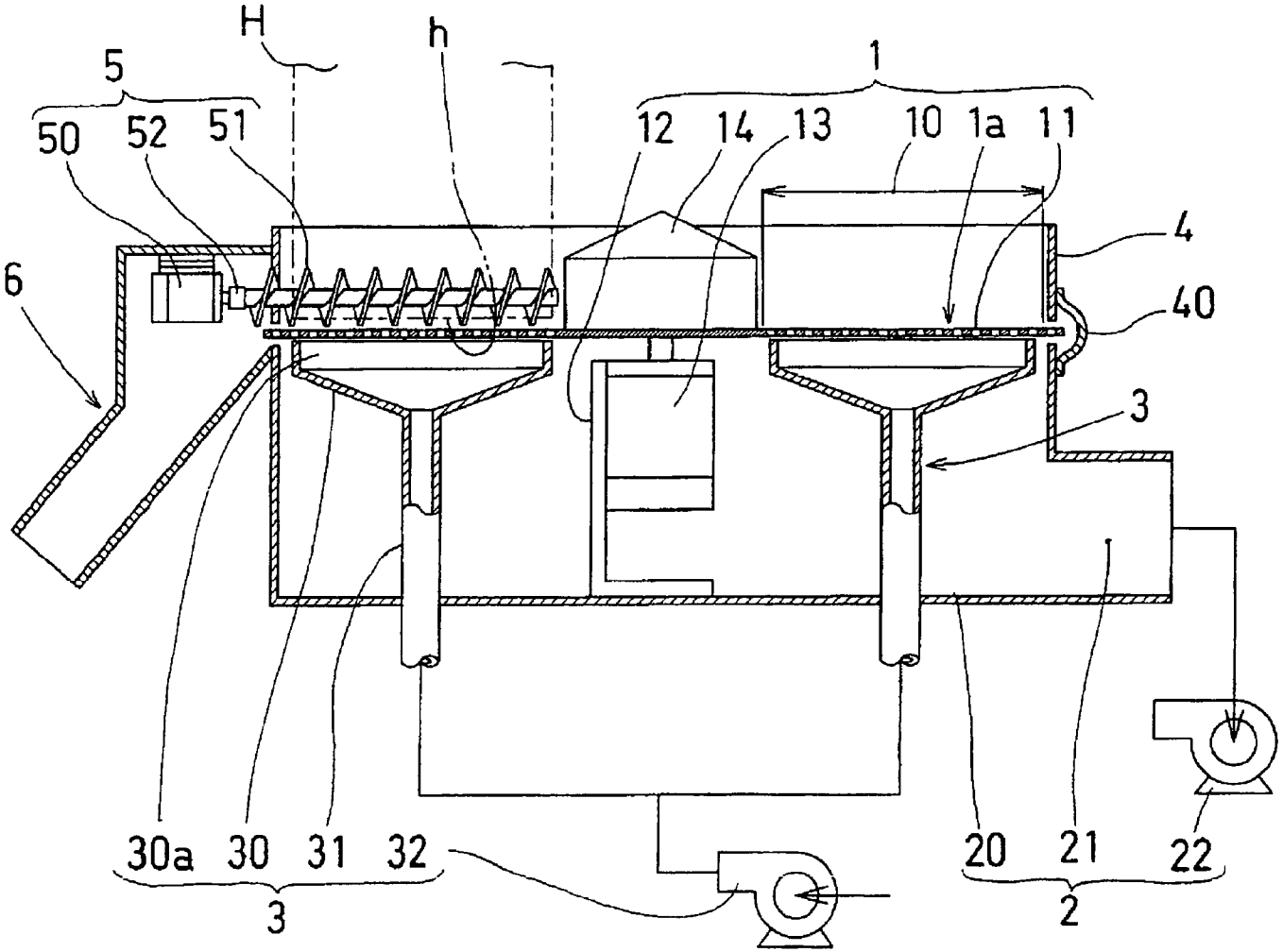
FIG. 1 is a sectional side view of a grain processor according to a first embodiment of the present invention.
Figure 2:
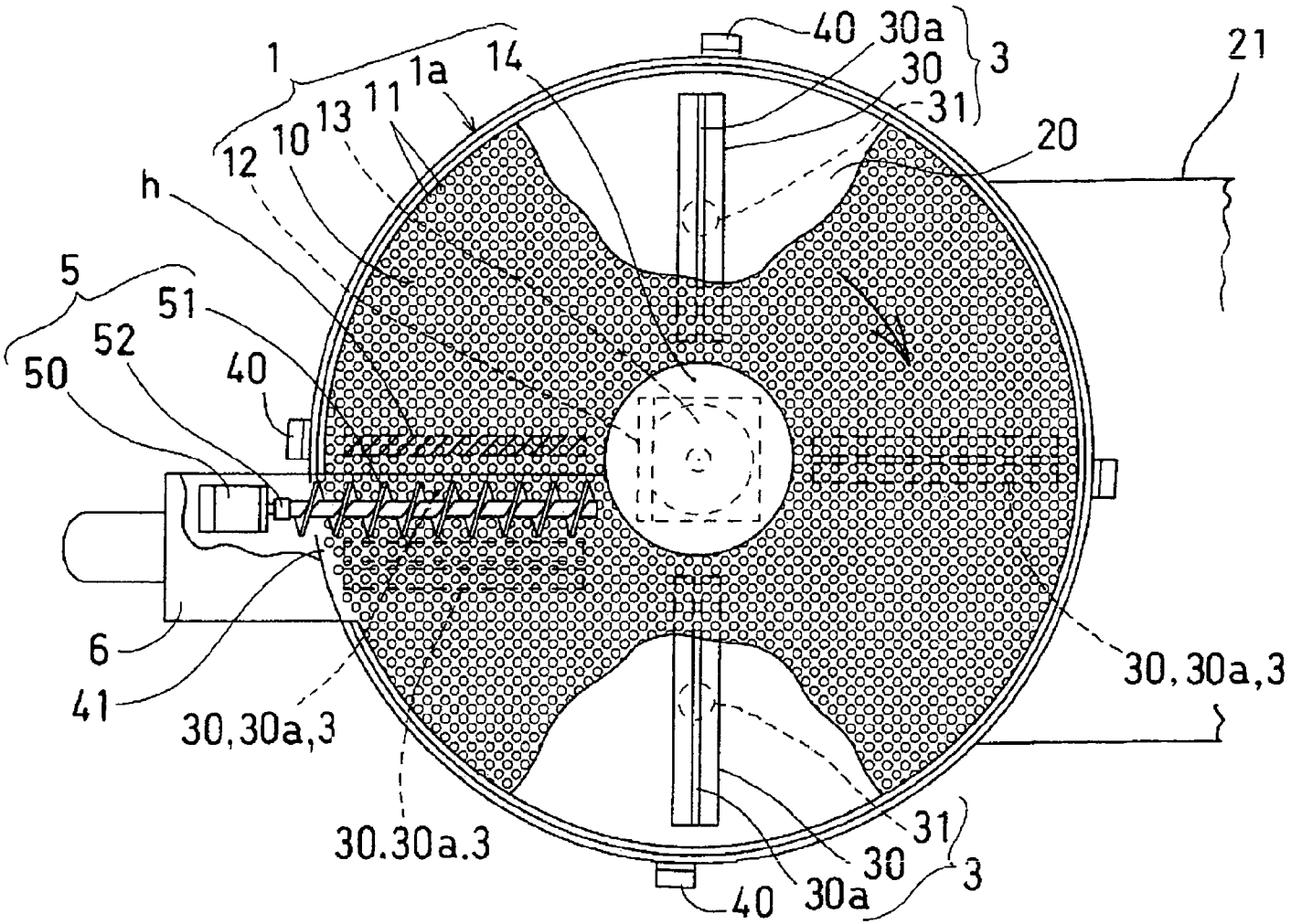
FIG. 2 is a plan view of the above.

This grain processor can substantially completely separate accretions and contaminants from grains, and can dry up the wet grains having water stuck onto their surfaces and permeated therein. As shown in FIGS. 1 and 2, the grain processor comprises a conveyor 1, air-suction means 2, air-blowing means 3, a circular periphery guard 4, discharging means 5 and a discharge chute 6.

The conveyor 1 will now be described.

As shown in FIGS. 1 and 2, the conveyor 1 is provided with a porous plate 1*a*, which is circular when viewed in plan and has holes 11, and with a reduction motor 13 for rotating the porous plate 1*a* attached to a bracket 12. By providing a cap 14 on the center of the porous plate 1*a*, a surface of the porous plate 1*a* between the vicinity of its outer peripheral edge and the outer peripheral edge of the cap 14 is defined as a conveying course 10. Namely, in this embodiment, the conveying course 10 of the conveyor 1 is looped.

The holes 11 in the porous plate 1*a* are smaller than target grains and larger than accretions accreting to the grains and contaminants intermingled with the grains. Namely, while the grains are prevented from passing the holes 11, accretions and contaminants to be separated from the grains can pass the holes 11.

The air-suction means 2 will now be described.

As shown in FIGS. 1 and 2, the air-suction means 2 sucks the air above the conveying course 10 of the conveyor 1 downward through the holes 11 to the under side thereof. The air-suction means 2 comprises a cylindrical container 20 whose diameter is slightly smaller than that of the porous plate 1*a*, a duct 21 connected to the container 20, and an air-suction pump 22 (may be substituted for an exhauster such as a fan or a compressor) connected to the duct 21. The outer peripheral side of the porous plate 1*a* is rotated sliding on an upper surface of a skid (not shown) attached to the top peripheral surface of the container 20. Namely, the air-suction means 2 of this embodiment has an air chamber constituted by the porous plate 1*a* and the container 20, and the air in the air chamber is sucked by the air-suction pump 22, whereby the air above the porous plate 1*a* is evenly sucked through all the holes 11 except the holes 11 opposed to later-discussed receptacles 30.

The air-blowing means 3 will now be described.

As shown in FIGS. 1 and 2, each of the air-blowing means 3 comprises the receptacle 30 rectangular when viewed in plan and having a long and narrow air-exhaust nozzle 30*a* on its upper surface, a duct 31 connected to the air exhaust nozzle 30*a* of the receptacle 30, and a blower 32 connected to the duct 31. As shown in FIG. 1, the receptacle 30 contacts the lower surface of the porous plate 1*a* through a skid (not shown) attached to the upper surface of the receptacle 30, thereby peripherally sealing the air exhaust nozzle 30*a*. Namely, while the holes 11 of the porous plate 1*a* positioned above the receptacles 30 are sealed and air is not sucked through these holes 11, air is blown up through the holes 11 opposed to the air exhaust nozzles 30*a*.

As shown in FIG. 2, the receptacles 30 are disposed to extend radially at intervals of about 90 degrees. Especially, two receptacles 30 are disposed below a later-discussed screw 51.

The circular periphery guard 4 will now be described.

As shown in FIGS. 1 and 2, the circular periphery guard 4 is cylindrical and diametrically substantially as large as the upper end of the container 20.

A skid (not shown) is attached to the lower end of the circular periphery guard 4 by plural connection plates 40 so as to touch the upper surface of the porous plate 1*a* softly. Namely, as shown in FIG. 1, the peripheral edge of the porous plate 1*a* is softly (rotatably) sandwiched between the lower end of the circular periphery guard 4 and the upper end of the container 20. As shown in FIG. 2, the circular periphery guard 4 is provided a discharge opening 41 at its part facing to the discharge chute 6.

The discharging means 5 will now be described.

As shown in FIGS. 1 and 2, the discharging means 5 is constructed by connecting the screw 51 to an output shaft of a motor 50 through a coupling 52. The motor 50 is attached to an upper wall of the discharge chute 6. The screw 51 is disposed in parallel to the porous plate 1*a* so that a blade of the screw 51 is extremely close to the porous plate 1*a*.

As shown in FIGS. 1 and 2, the discharge chute 6 drops grains conveyed by the conveying course 10 to transport the grains to another position or device.

Next, explanation will be given of action and effect of the grain processor.

When the grain processor is used, the following separation and drying can be ensured. Incidentally, in FIGS. 1 and 2, a reference numeral H designates a hopper for supplying grains, which may have accretions, contaminants or water adhering to their surfaces, onto the conveying course 10 of the grain processor. A reference numeral h (diagonally shaded area in FIG. 2) designates a discharge opening of the hopper H.

Firstly, things done before starting work will be described.

The air-suction pump 22, the blower 32, the reduction motor 13 and the motor 50 are started.

Accordingly, air is blown upward from the air exhaust nozzles 30*a* of each receptacle 30 to the upper side of the conveying course 10 through the holes 11 opposed to the air exhaust nozzles 30*a*. Namely, air is blown up along the radial lines on the conveying course 10 at intervals of about 90 degrees. Air above the conveying course 10 is sucked to the under side of the conveying course 10 through the holes 11 not opposed to the receptacles 30.

On the other hand, the porous plate 1*a* rotates clockwise when viewed in plan, and the screw 51 rotates in its discharging direction.

Next, explanation will be given on the operation of separating accretions or contaminants from grains.

When accretions accreting to grains or contaminants intermingled with grains are taken into the hopper H, they continuously fall from the discharge opening h at the lower end of the hopper H to the diagonally shaded area in FIG. 2 on the porous plate 1*a* rotating clockwise. When the porous plate 1*a* rotates a little less than one round, the accretions or the contaminants reach the screw 51 of the discharging means 5, and are taken into the discharge chute 6 by rotation of the screw 51. While the grains with others are conveyed by the rotating porous plate 1*a*, the grains with others on the plate 1*a* are subjected to the air-suction power of the suction pump 22 connected to the duct 21 so that the accretions accreting to the grains are peeled from the grains by the fast and powerful air flow passing the grains and sucked downward through the holes 11 as well as the contaminants in the grains are sucked. The accretions and contaminants reaching the suction pump 22 are separated from the air by a dust separator (not shown).

Lumps of grains adhering with each other may be ventilated insufficiently to have the above-mentioned air-suction effect. However, in the present grain processor, when the grains come to the positions of the air-exhaust nozzles 30*a* along the lower surface of the porous plate 1*a*, the grains are blown up by the air exhausted from the air-exhaust nozzles 30*a*. Though the grains fall down immediately after that, the positional relation of the grains is changed completely, whereby an aperture is generated between adhering grains of each lump so that accretions accreting to the adhering grains are peeled and sucked by the fast and powerful passing air.

As mentioned above, the present grain processor applies suction air power and blowing air power onto grains in opposite directions since the grains fall on the porous plate 1*a* till the grains are discharged through the discharge opening 41. The positional relation of the grains is changed on every passing the air-blowing position, whereby each of the grains can be separated from accretion even if accreting to its whole surface. Furthermore, when the grains are turned, that is, when the grains come to each air exhaust nozzle 30*a*, the holes 11 of the conveying course 10 are closed by the receptacle 30, whereby the grains are released from the sucking air. In this condition, the grains are only pressured upward by the air from the air exhaust nozzles 30*a*, whereby the grains are prevented from rubbing with one another to rough their surfaces. Moreover, when the processed grains are discharged from the conveying course 10, the grains are floated from the conveying course 10 by the air exhausted from the air-exhaust nozzles 30*a* positioned just under the screw 51 of the discharging means 5 so as to be sent to the outer periphery of the conveying course 10 by rotation of the screw 51 and discharged through the discharge opening 41 to the discharge chute 6. Therefore, all of the discharged grains are prevented from rubbing at the surfaces thereof with one another, thereby being discharged while keeping their fine surfaces.

Shortly, by using this grain processor, accretions accreting to grains or contaminants intermingled with grains can be substantially completely separated from the grains without damaging surfaces of the grains, and all of them are removed from the grain processor after processed.

In this case, if it is desirable to dry up the grains, what is necessary is just to supply dehumidified air or hot air. If the moisture of the grains must not be changed, air having controlled humidity should be supplied.

The operation of drying up wet grains will now be described.

In the present grain processor, the grains subjected to the suction air of the air-suction pump 22 are prevented from dispersing, thereby being dried up for a short time even if the suction pump 22 sucks strongly. In addition, in this grain processor, the grains can be changed in their positional relation without getting scratch thereon, whereby so-called uneven dryness can be prevented.

If the grain processor is used as a dryer, the time of drying up grains can be further shortened by supplying dehumidified air or hot air. In this case, it is desirable to increase the rotation speed of the reduction motor 13 by an inverter or the like.

Next, explanation will be given of a grain processor according to a second embodiment of the present invention.

Figure 3:
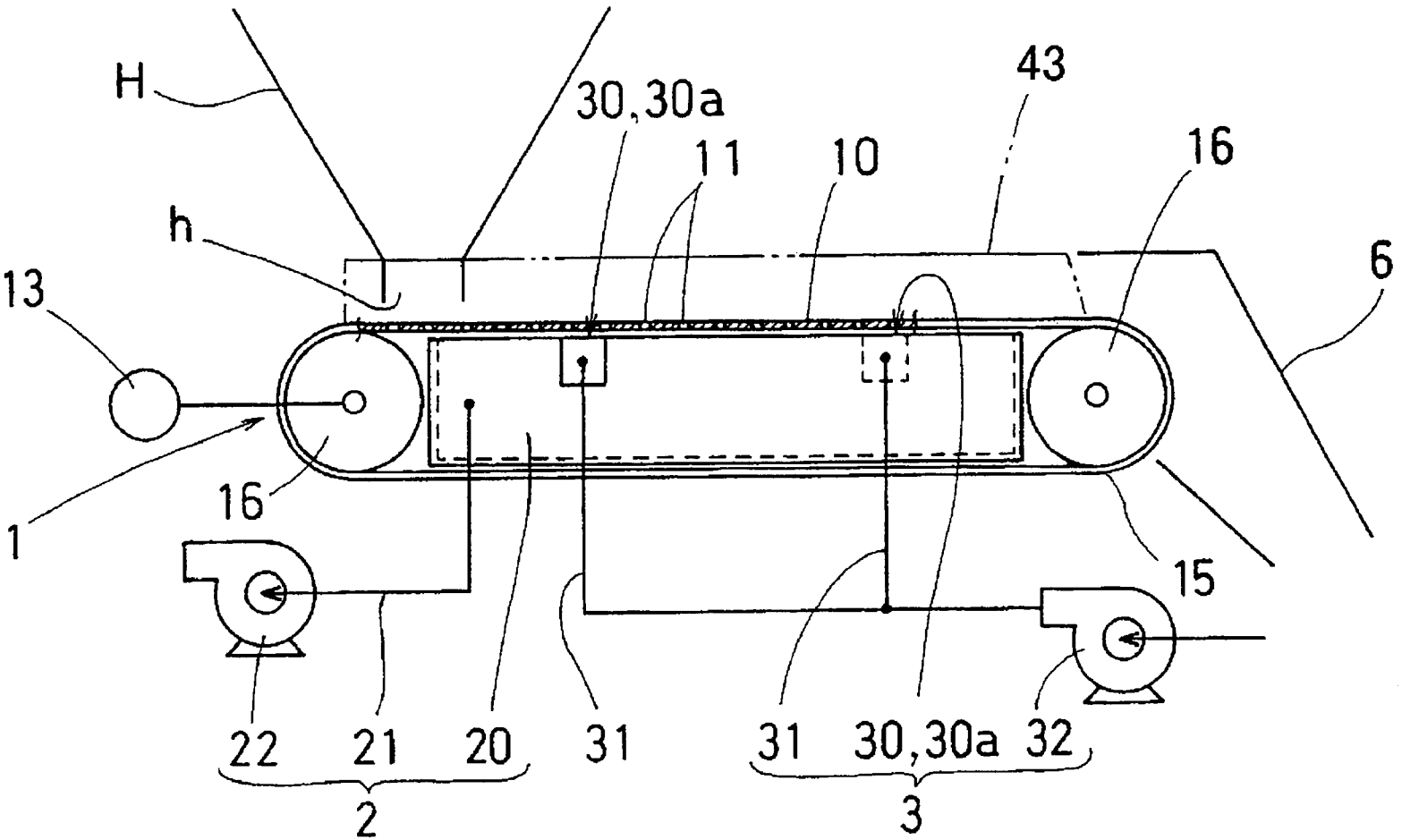
FIG. 3 is a sectional side view of a grain processor according to a second embodiment of the present invention.

The porous plate 1*a* of the above-mentioned first embodiment is a turntable which is circular when viewed in plan. Alternatively, the porous plate 1*a* may be a belt conveyor type as shown in FIG. 3, for example. Reference numerals used in FIG. 3 designate the same parts as those in the first embodiment.

As shown in FIG. 3, the belt-conveyor type grain processor of the second embodiment has the conveying course 10 provided on a net conveyor belt 15 having holes 11 instead of the circular porous plate 1*a*. The net conveyor belt 15 is stretched between a pair of rollers 16, and one of the rollers 16 is driven by the reduction motor 13. As drawn in two-dot chain lines in FIG. 3, flat plate-like guards 43 are disposed on both sides of the net conveyor belt 15 in parallel to each other so as to prevent the grains on the conveying course 10 from falling therefrom.

The grain processor of this embodiment needs no discharging means 5.

The present invention is not limited to the above-mentioned embodiments.

With regard to the first embodiment, the grain processor is provided for drying and separation, so that the holes 11 formed in the porous plate 1*a* are smaller than target grains and larger than accretions accreting to the grains and contaminants intermingled with the grains. However, if the purpose is only drying, only the thing required for the holes 11 formed in the porous plate 1*a* is only to be smaller than the grains.

Positions of the air-blowing means 3 are not limited to those of the above-mentioned embodiments, and should be just disposed corresponding to the form of the conveying course 10. Shortly, what is necessary is just to apply the blowing-up air power onto all of the grains in the cross direction of the conveying course 10.

Furthermore, the number of the air-blowing means 3 is not limited to that of the above-mentioned embodiments, and can be selected corresponding to the state of grains to be separated and/or dried up.

INDUSTRIAL APPLICABILITY

The grain processor according to the present invention can be used for processing grains, e.g., rice or other cereals and pulse such as soybeans. If the grain processor is used for processing rice, bran accreting to or intermingled with the rice can be substantially completely separated without damaging surfaces of the rice, and wet rice, whether water is stuck on their surfaces or permeated therein, can be dried up uniformly. Even if processing grains other than rice, the grain processor ensures the good effect of separation and drying of the grains.

What is claimed is:

1. A grain processor for separating grains from accretions accreting to the grains or contaminants intermingled with the grains comprising:

a conveyor having holes in a conveying course thereof, wherein the holes are smaller than the grains and are sized optimally for passing the accretions and the contaminants therethrough, and the grains are placed on an upper surface of the conveyor;

air-suction means, wherein the air above the surface is sucked downward to a lower side of the conveying course through the holes by the air-suction means; and air-blowing means, wherein the air-blowing means blows air upward from the lower side of the conveying course to the upper side of the conveying course through the holes at a predetermined position in the conveying course so as to apply blowing-up force onto the conveyed grains reaching the predetermined position, wherein an opening of the air-blowing means for blowing air has the same width as the width of the conveying course.

2. The grain processor according to claim 1, wherein the conveyor is constituted by a turntable which is circular when viewed in plan and rotated by a motor.

3. The grain processor according to claim 2, further comprising: a screw serving as discharging means disposed in the conveying course so as to discharge the grains from the conveying course, wherein the air-blowing means is disposed below the discharging means.

4. A grain processor for separating grains from accretions accreting to the grains or contaminants intermingled with the grains comprising:

a net conveyor belt having holes, wherein the holes are smaller than the grains and are sized optimally for passing the accretions and the contaminants therethrough, and the grains are placed on an upper surface of the net conveyor belt;

air-suction means, wherein the air above the net conveyor belt is sucked downward to a lower side of the net conveyor belt through the holes by the air-suction means; and air-blowing means, wherein the air-blowing means blows air upward from the lower side of the net conveyor belt to the upper side of the net conveyor belt through the holes at a predetermined position in the net conveyor belt so as to apply blowing-up force onto the conveying grains reaching the predetermined position, wherein an opening of the air-blowing means for blowing air has the same width as the width of the net conveying belt.

* * * * *